US007077195B2

(12) United States Patent
Zotta

(10) Patent No.: US 7,077,195 B2
(45) Date of Patent: Jul. 18, 2006

(54) BOREHOLE CLOSURE

(75) Inventor: Joachim Zotta, Bad Sachsa (DE)

(73) Assignees: Perforator GmbH, Walkenried (DE); Carbo Tech Fosroc GbmH, Essen (DE)

( * ) Notice: Subject to any disclaimer, the term of this patent is extended or adjusted under 35 U.S.C. 154(b) by 252 days.

(21) Appl. No.: 10/483,911

(22) PCT Filed: Jun. 21, 2002

(86) PCT No.: PCT/DE02/02267

§ 371 (c)(1),
(2), (4) Date: Jan. 15, 2004

(87) PCT Pub. No.: WO03/008762

PCT Pub. Date: Jan. 30, 2003

(65) Prior Publication Data

US 2004/0216870 A1 Nov. 4, 2004

(30) Foreign Application Priority Data

Jul. 19, 2001 (DE) ..... 101 35 159

(51) Int. Cl.
*E21B 33/127* (2006.01)

(52) U.S. Cl. ..... 166/187; 138/93; 166/192; 277/333

(58) Field of Classification Search ..... 166/187, 166/192; 277/333; 138/93
See application file for complete search history.

(56) References Cited

U.S. PATENT DOCUMENTS

| | | | | |
|---|---|---|---|---|
| 2,812,822 | A * | 11/1957 | O'Reilly | 166/326 |
| 2,831,542 | A * | 4/1958 | Lynes et al. | 285/298 |
| 3,726,319 | A * | 4/1973 | Patterson | 138/90 |
| 4,268,043 | A * | 5/1981 | Forssell | 277/333 |

FOREIGN PATENT DOCUMENTS

| | | |
|---|---|---|
| DE | 24 02 509 | 7/1975 |
| DE | 30 14 834 A1 | 10/1981 |
| DE | 42 09 802 C | 8/1993 |
| EP | 0 398 838 A | 11/1990 |

* cited by examiner

*Primary Examiner*—Hoang Dang
(74) *Attorney, Agent, or Firm*—Henry M. Feiereisen

(57) ABSTRACT

A borehole closure includes a supply line made of plastic and having formed therein a longitudinal passage between a feed end for inlet of an impregnating fluid and a discharge end. The supply line is formed with transverse passages, each covered by a sealing ring. A non-return valve is provided to block a flow of impregnating fluid in the direction toward the feed end. The supply line is sealingly surrounded by an inflating tube to define an elongate annular chamber therebetween which is in communication with the transverse passages. A rupture assembly having a rupture disk is secured at an end surface of the discharge end of the supply line and constructed to burst when a pressure applied by the impregnating fluid exceeds a predetermined value.

23 Claims, 2 Drawing Sheets

BOREHOLE CLOSURE

BACKGROUND OF THE INVENTION

Borehole closures are used as auxiliary means, i.a., in mining, underground mining as well as in the field of building rehabilitation for injection of, for example, turbid cement, synthetic resin, water glass or the like into the rock formation or masonry. With the assistance of these impregnating fluids, the rock formation or the masonry is intended to be consolidated. Also seals can be realized.

Within the scope of DE 42 09 802 C1, a borehole closure is known which has been proven in practice. Practice has also shown that improper handling, especially during insertion of the borehole closure in a bore, led oftentimes to a cracking of the supply line within the inflating tube, when the supply line is made of plastic. The reason for that is an circumferential inward turning of the supply line in the region of the transverse passages, which connect the longitudinal passage in the supply line with the annular chamber between the supply line and the inflating tube, for fixedly securing a sealing ring, which covers the ports of the transverse passages and reduces the cross section of the supply line. As a result, the borehole closure becomes useless.

Also EP 0 398 838 A1 shows a borehole closure of this type.

DE 24 02 509 A1 discloses a tubular one-way borehole closure for injection of synthetic resin, including a pipe piece with sleeve-like inlet and outlet parts. Secured to the inlet and outlet parts is a tube portion of elastic material with band clamps. Disposed on the outlet part is a non-return valve with a ball and an axially aligned slotted heavy type dowel pin. When the ball rests upon the opening of heavy type dowel pin, the slot in the heavy type dowel pin assumes the function of a throttle path for the injection medium. Furthermore, the central part of the pipe piece with the provided transverse passages on the circumference is not weakened by a groove.

DE 30 14 834 A1 conveys to the artisan a borehole closure with non-covered transverse passages between an annular chamber, which is formed by a rubber tube and a pipe piece, and the interior of the pipe piece. The transverse passages are provided off-center of the annular chamber extension. Further described is the installation of non-return valves on the feed end as well as also on the discharge end.

Starting from the state of the art, the invention is based on the object to provide a borehole closure which is more flexible to adapt to local conditions and which can easily be placed in appropriate position in a borehole, even when handled improperly.

SUMMARY OF THE INVENTION

This object is attained according to the invention by the features of claim 1 a borehole closure which includes a supply line which is made of plastic and has a feed end with an external thread and a discharge end with an external thread as well as an integrated non-return valve blocking in the direction toward the feed end, and which has a longitudinal passage, and an inflating tube which surrounds the supply line in a sealing manner with its end portions at formation of an elongate annular chamber, wherein at an end of the annular chamber the wall of the supply line is provided with transverse passages having ports into the annular chamber which are covered by elastic sealing rings, with neighboring fixing rings positioned on both sides thereof, and a rupture disk which is secured at an end surface of the discharge end of the supply line by a thrust ring with inner shearing edge and a threaded sleeve with inner radial shoulder.

The provision of a supply line of plastic (tube or pipe of especially thermoplastic material, preferably a ABS copolymer) in conjunction with the fact that the non-return valve is no longer provided at the feed end but at the discharge end of the supply line now enables in principal the use of a supply line of unlimited length to suit local conditions of the user of a borehole closure, because only an external thread is attached to the feed end for coupling with a supply for the impregnating fluid. In this way, flexibility is enhanced during use of the borehole closure.

is no longer provided at the feed end but at the discharge end of the supply line now enables in principal the use of a supply line of unlimited length to suit local conditions of the user of a borehole closure, because only an external thread is attached to the feed end for coupling with a supply for the impregnating fluid. In this way, flexibility is enhanced during use of the borehole closure.

Especially advantageous is further the measure to introduce the impregnating fluid via the transverse passages only at the end of the annular chamber between the supply line and the inflating tube. In this way, the annular chamber can evenly be filled and a better bracing of the inflating tube against the borehole wall is assured in order to fixedly secure the borehole closure.

The supply line is no longer weakened in cross section in the region of the transverse passages. Rather, the sealing rings associated to the transverse passages are restrained in their position by securing rings provided on both sides of the sealing rings. Hereby, the use of elastic securing rings, in particular rubber rings, may be involved which however envelope the supply line firm enough to ensure their disposition on the supply line and reliably guide the sealing rings.

The distribution of the transverse passages at an axial distance from one another in the end regions of the annular chamber as well as the absence of circumferential grooves significantly improve the stability of the supply line so that even rough handling of the borehole closure no longer results in a destruction of the supply line.

Non-return valve and rupture disk are provided together at the discharge end of the supply line. The rupture disk is disposed at the end surface of the discharge end and fixed via a threaded sleeve to an inner annular radial shoulder with the assistance of a thrust ring with inner shearing edge. The inner shearing edge is provided so that the rupture disk is pushed against this shearing edge, when pressure builds up inside the borehole closure, and bursts as soon as a predetermined resistance has been exceeded. The size of the inner diameter of the thrust ring depends on the respectively demanded bursting pressure of the rupture disk or the required throughput amount of the impregnating fluid. The threaded sleeve may, optionally, be configured as double-threaded sleeve so that an extension in the form of an injection pipe can be inserted in the further internal thread, if need be.

As a consequence of the 90° offset circumferential disposition of the transverse passages which are provided at the end of the annular chamber in the wall of the supply line, the stability of the supply line is additionally enhanced.

According to a further advantageous feature of the invention the outlet side end of the inflating tube is fixedly secured on the supply line. In this way, an inadvertent shift of the supply line relative to the inflating tube is avoided and care is taken on purpose to prevent the supply line from shifting relative to the inlet-side end of the inflating tube, when the annular chamber is filled and the inflating tube is pressed against the wall of the borehole.

According to a further feature of the invention, the non-return valve is comprised of a ball pressed against the port of the longitudinal passage in the supply line, a compression spring, and an abutment ring. The abutment ring is rotated into an internal thread of the discharge end of the supply line. The compression spring, in particular configured in the form of a helical compression, is supported on the abutment ring, on one hand, and on the ball, on the other hand. For better handling, the abutment ring is provided with a transverse slot which is disposed in the end surface contacting the rupture disk.

The function of the rupture disk is secured in an optimized manner, when the inner diameter of the thrust ring is greater than the inner diameter of the abutment ring, but smaller than the inner diameter of the radial shoulder in the threaded sleeve.

BRIEF DESCRIPTION OF THE DRAWING

Exemplified embodiments of the invention are described in more detail with reference to the drawings, in which.

DETAILED DESCRIPTION OF PREFERRED EMBODIMENTS

Figure 1:
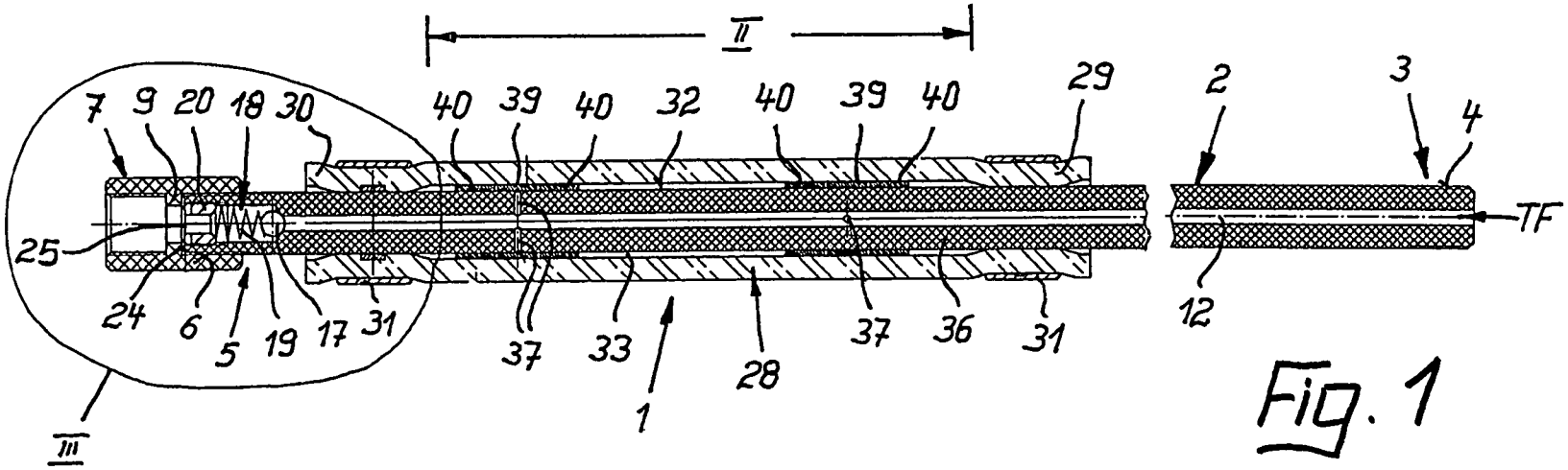
FIG. 1 shows a vertical longitudinal section of a borehole closure.

1 designates in FIG. 1 a borehole closure as used, e.g. for solidification of the rock formation in underground mining and for sealing fissures and cracks in rock formation through injection of a impregnating fluid TF, such as, e.g., turbid cement, via the borehole closure into the rock formation.

The borehole closure 1 has a supply line 2 formed with a longitudinal passage and made of plastic, such as glass fiber reinforced acrylnitril-butadien-styrene. Provided on the feed end 3 of the supply line 2 for the impregnating fluid TF is an external thread 4 for attachment of, e.g, a conduit for supply of the impregnating fluid TF.

Figure 3:
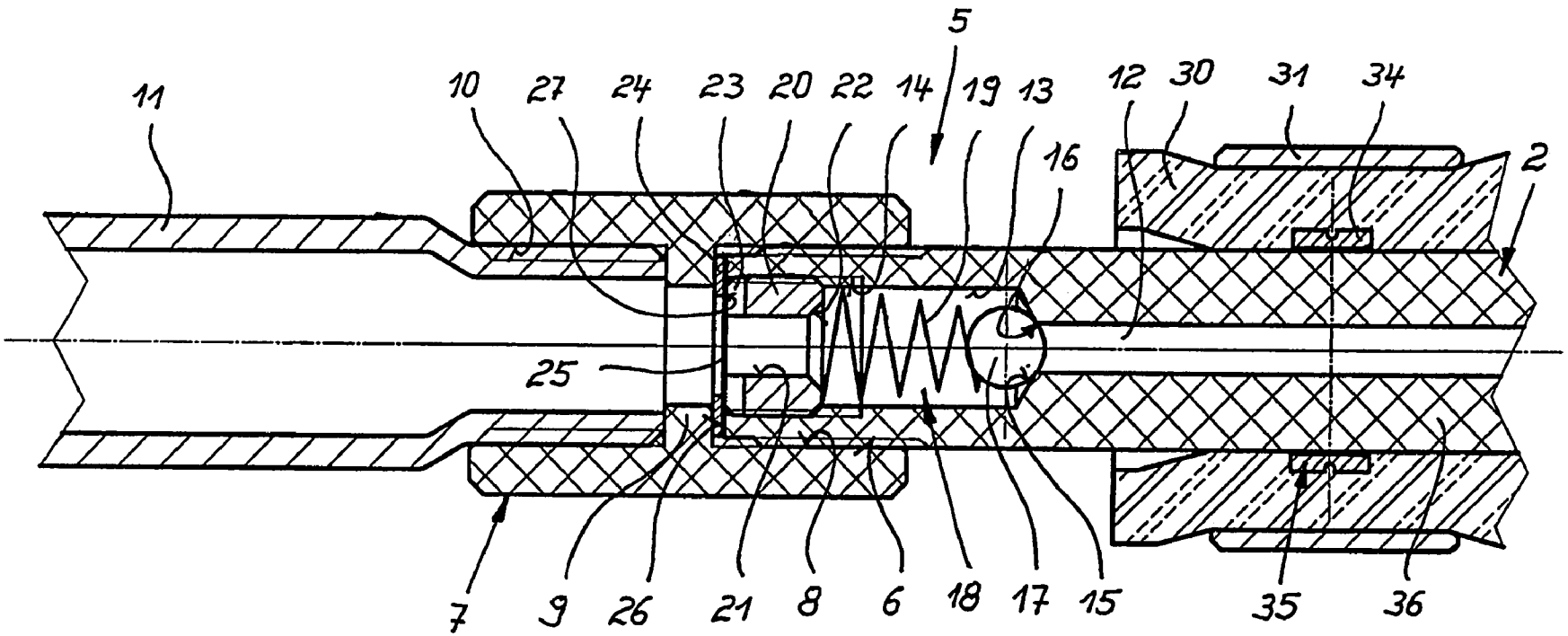
FIG. 3 shows again on an enlarged scale the section III of FIG. 1 according to a further embodiment.

Provided on the discharge end 5 of the supply line 2 (FIGS. 1 and 3) is an external thread for threaded engagement of a threaded sleeve 7 made of polypropylene and including an internal thread 8. In the exemplified embodiment, the threaded sleeve 7 is configured as double-thread sleeve, whereby the internal thread 8, which is intended for attachment to the supply line 2, is separated from a further internal thread 10 by an inner annular radial shoulder 9. This further internal thread 10 is intended for securement of an injection pipe 11, in the event such an injection pipe 11 should be needed. Instead of the illustrated double-thread sleeve 7, it is also possible to use a single-thread sleeve without the section with the further internal thread 10.

The longitudinal passage 12 is widened in the discharge end 5 of the supply line 2. Provided are a cylindrical length section 13 and a threaded section 14. The longitudinal passage 12 connects via a cone 15 into the cylindrical length section 13. The transition edge 16 from the longitudinal passage to the cone 15 serves as sealing edge for a ball 17 which is made of steel and forms part of a non-return valve 18. The non-return valve 18 further includes a spring 19 in the form of a helical compression spring of spring steel, which, on the one hand, rests on the ball 17 and, on the other hand, on an abutment ring 20 made of brass and turned into the threaded section 14 of the discharge end 5. Provided in the abutment ring 20 is a longitudinal bore 21 which terminates in a cone 22 which expands in the direction of the spring 19. On the other side, the abutment ring 20 is formed with a transverse slot 23 which is provided for handling the abutment ring 20.

The threaded sleeve 7 provides together with a thrust ring 24 of steel the securement of a rupture disk 25 of aluminum on the end surface 26 of the discharge end 5 of the supply line 2. It is important hereby that the inner edge 27 of the thrust ring 24 bears against the rupture disk 25 with a sharp-edged configuration. Moreover, a reliable function of the rupture disk 25 is realized, when the inner diameter of the thrust ring 24 is greater than the inner diameter of the longitudinal bore 21 in the abutment ring 20, but is smaller than the inner diameter of the radial shoulder 9 in the threaded sleeve 7.

Figure 2:
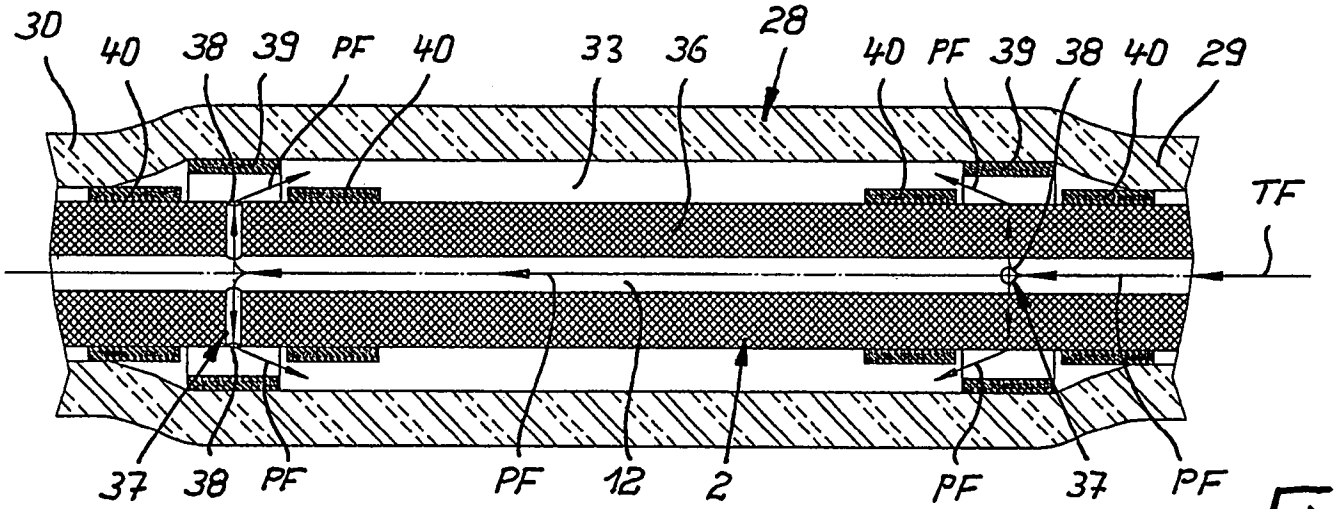
FIG. 2 shows the length portion II, on an enlarged scale, of the borehole closure of FIG. 1 during admission of an impregnating fluid.

The borehole closure 1 further includes, as is shown in FIGS. 1 and 2, an inflating tube 28 which envelopes the supply line 2. The ends 29, 30 of the inflating tube 28 are pressed upon the outer surface 32 of the supply line 2 by clamp rings 31 of steel. In this way, an elongate annular chamber 33 is formed between the supply line 2 and the inflating tube 28. It can further be seen that an inner ring cavity 34 is provided in the end 30 of the inflating tube 28, adjacent to the discharge end 5 of the supply line 2, for embedment of a fixing ring 35 made of steel and firmly surrounding the supply line 2. This fixing ring 35 has the task to fixedly secure the inflating tube 28 in longitudinal direction upon the supply line 2, when impregnating fluid TF is transferred into the annular chamber 33 via the longitudinal passage 12 of the supply line and via transverse passages 37 provided at the end of the annular chamber 33 in the wall 36 of the supply line 37 in order to press the inflating tube 28 against the borehole wall, not shown in more detail. The end 30 of the inflating tube 28 adjacent to the discharge end 5 of the supply line 2 remains hereby firmly positioned on the supply line 2, while the supply line 2 is able to move relative to the other end 29 of the inflating tube 28.

The ports 38 of the transverse passages 37 into the annular chamber 33 are covered by elastic sealing rings 39 of rubber. Disposed on both sides next to the sealing rings 39 are fixing rings 40, preferably also made of elastic material like rubber, which firmly embrace, however, the supply line 2. These fixing rings 40 are provided for guiding the sealing rings 39.

After insertion of the borehole closure 1 according to FIG. 1 in a borehole, not shown in more detail, during mining operation in underground mining, impregnating fluid TF is admitted through the supply line 2 via the feed end 3. As the rupture disk 25 inhibits a flow of impregnating fluid TF, impregnating fluid TF exits the longitudinal passage 12 of the supply line 2 according to the arrows PF of FIG. 2 via the transverse passages 37 into the annular chamber 33, whereby the sealing rings 39 expand and brace the inflating tube 28 against the borehole wall. A further increase in pressure of the impregnating fluid TF causes the rupture disk 25 to burst at a predetermined pressure upon the thrust ring 24 under the effective influence of the shearing edge 27 so that the impregnating fluid TF is able to enter via the non-return valve 18, the abutment ring 20, the thrust ring 24 and the threaded sleeve 7 into the borehole section positioned therebehind and thus into the rock formation.

The non-return valve 18 prevents a backflow of the impregnating fluid TF into the longitudinal passage 12 of the supply line 2, while the sealing rings 39 on the circumference of the transverse passages 37 inhibit a return flow of the impregnating fluid TF from the annular chamber 33 into the longitudinal passage 12, when impregnating fluid TF is no longer added.

What is claimed is:

1. A borehole closure, comprising:

a supply line made of plastic and having formed therein a longitudinal passage between a feed end for inlet of an impregnating fluid and a discharge end, said supply line being formed with transverse passages, each covered by a sealing ring;

a non-return valve constructed to block a flow of impregnating fluid in the direction toward the feed end and disposed at the discharge end of the supply line;

an inflating tube which sealingly surrounds the supply line to define an elongate annular chamber therebetween in communication with the transverse passages; and a rupture assembly having a rupture disk secured at an end surface of the discharge end of the supply line and constructed to burst when a pressure applied by the impregnating fluid exceeds a predetermined value.

2. The borehole closure of claim 1, wherein the feed end is formed with an external thread for attachment of a conduit for supply of impregnating fluid.

3. The borehole closure of claim 1, wherein the discharge end is formed with an external thread, said rupture assembly including a threaded sleeve attached to the external thread of the discharge end and formed with an inner radial shoulder, and a thrust ring with inner shearing edge, said threaded sleeve and said thrust ring securing the rapture disk in place.

4. The borehole closure of claim 3, wherein the inner shearing edge has a sham-edged configuration and bears against the rupture disk.

5. The borehole closure of claim 1, wherein the transverse passages are arranged in proximity to an end of the annular chamber distal to the feed end.

6. The borehole closure of claim 1, wherein the transverse passages are disposed circumferentially in 90° offset relationship.

7. The borehole closure of claim 1, wherein the inflating tube has one end in proximity of the discharge end of the supply line, said one end of the inflating tube being firmly secured upon the supply line.

8. A borehole closure, comprising:

a supply line made of plastic and having formed therein a longitudinal passage between a feed end for inlet of an impregnating fluid and a discharge end, said supply line being formed with transverse passages, each covered by a sealing ring;

a non-return valve constructed to block a flow of impregnating fluid in the direction toward the feed end;

an inflating tube which sealingly surrounds the supply line to define an elongate annular chamber therebetween in communication with the transverse passages;

a rupture assembly having a rupture disk secured at an end surface of the discharge end of the supply line and constructed to burst when a pressure applied by the impregnating fluid exceeds a predetermined value; and fixing rings for securing the sealing rings on both sides thereof to the supply line.

9. The borehole closure of claim 8, wherein the feed end is formed with an external thread for attachment of a conduit for supply of impregnating fluid.

10. The borehole closure of claim 8, wherein the discharge end is formed with an external thread, said rupture assembly including a threaded sleeve attached to the external thread of the discharge end and formed with an inner radial shoulder, and a thrust ring with inner shearing edge, said threaded sleeve and said thrust ring securing the rupture disk in place.

11. The borehole closure of claim 10, wherein the inner shearing edge has a sharp-edged configuration and bears against the rupture disk.

12. The borehole closure of claim 8, wherein the transverse passages are arranged in proximity to a feed end distal end of the annular chamber.

13. The borehole closure of claim 8, wherein the transverse passages are disposed circumferentially in 90° offset relationship.

14. The borehole closure of claim 8, wherein the inflating tube has one in proximity of the discharge end of the supply line, said one end of the inflating tube being firmly secured upon the supply line.

15. A borehole closure, comprising:

a supply line made of plastic and having formed therein a longitudinal passage between a feed end for inlet of an impregnating fluid and a discharge end, said supply line being formed with transverse passages, each covered by a sealing ring;

a non-return valve constructed to block a flow of impregnating fluid in the direction toward the feed end;

an inflating tube which sealingly surrounds the supply line to define an elongate annular chamber therebetween in communication with the transverse passages; and a rupture assembly having a rupture disk secured at an end surface of the discharge end of the supply line and constructed to burst when a pressure applied by the impregnating fluid exceeds a predetermined value;

wherein the non-return valve includes a ball, a compression spring for pressing the ball against an outlet port of the longitudinal passage in the supply line, and an abutment ring having an end surface which contacts the rupture disk and is provided with a transverse slot.

16. The borehole closure of claim 15, wherein the abutment ring is threadably received in the discharge end of the supply line, with the compression spring extending between the ball and an opposite end surface of the abutment ring.

17. The borehole closure of claim 15, wherein the discharge end is formed with an external thread, said rupture assembly including a threaded sleeve attached to the external thread of the discharge end and formed with an inner radial shoulder, and a thrust ring with inner shearing edge for securing the rupture disk in place, said thrust ring having an inner diameter which is greater than an inner diameter of the abutment ring and smaller than an inner diameter of the radial shoulder in the threaded sleeve.

18. The borehole closure of claim 15, wherein the feed end is formed with an external thread for attachment of a conduit for supply of impregnating fluid.

19. The borehole closure of claim 15, wherein the discharge end is formed with an external thread, said rupture assembly including a threaded sleeve attached to the external thread of the discharge end and formed with an inner radial shoulder, and a thrust ring with inner shearing edge, said threaded sleeve and said thrust ring securing the rupture disk in place.

20. The borehole closure of claim 19, wherein the inner shearing edge has a sharp-edged configuration and bears against the rupture disk.

21. The borehole closure of claim 15, wherein the transverse passages are arranged in proximity to a feed end distal end of the annular chamber.

22. The borehole closure of claim 15, wherein the transverse passages are disposed circumferentially in 90° offset relationship.

23. The borehole closure of claim 15, wherein the inflating tube has one in proximity of the discharge end of the supply line, said one end of the inflating tube being firmly secured upon the supply line.

* * * * *

UNITED STATES PATENT AND TRADEMARK OFFICE

CERTIFICATE OF CORRECTION

PATENT NO. : 7,077,195 B2
APPLICATION NO. : 10/483911
DATED : July 18, 2006
INVENTOR(S) : Joachim Zotta It is certified that error appears in the above-identified patent and that said Letters Patent is hereby corrected as shown below:

TITLE Page (73) Assignees: Change "Carbo Tech Fosroc GbmH" to

--Carbo Tech Fosroc GmbH--

Column 2, delete entire paragraph from line 15 to line 21

Column 5, line 36: change "sham-edged" to --sharp-edged--

Column 6, line 18: change "one in" to --one end in--

Signed and Sealed this

Fifth Day of December, 2006

JON W. DUDAS
*Director of the United States Patent and Trademark Office*